United States Patent [19]

Haberthür

[11] Patent Number: 4,811,923

[45] Date of Patent: Mar. 14, 1989

[54] MOUNT FOR PHOTOGRAPHIC LIGHTING EQUIPMENT

[75] Inventor: Walter Haberthür, Hofstetten, Switzerland

[73] Assignee: Bron Elektronik AG, Allschwil, Switzerland

[21] Appl. No.: 92,014

[22] Filed: Sep. 2, 1987

[30] Foreign Application Priority Data

Feb. 25, 1987 [DE] Fed. Rep. of Germany ... 702841[U]

[51] Int. Cl.[4] ..... E04G 3/00

[52] U.S. Cl. ..... 248/278; 248/282; 248/291; 362/3; 362/269

[58] Field of Search ..... 248/278, 279, 282, 284, 248/289.1, 291; 362/3, 287, 269, 427; 354/149.1, 261

[56] References Cited

U.S. PATENT DOCUMENTS

| | | | |
|---|---|---|---|
| 1,842,224 | 1/1932 | Wells | 248/278 |
| 3,040,993 | 6/1962 | Schultz | 362/269 |
| 3;086,107 | 4/1963 | Grover | 248/278 X |
| 3,333,093 | 7/1967 | Robinson | 362/3 |
| 4,075,470 | 2/1978 | Moore | 362/287 |
| 4,114,170 | 9/1978 | Furukawa | 354/149.1 |
| 4,419,721 | 12/1983 | Gregorie et al. | 362/287 X |
| 4,527,224 | 7/1985 | Sangiamo et al. | 362/269 X |

*Primary Examiner*—Ramon O. Ramirez
*Attorney, Agent, or Firm*—Becker & Becker

[57] ABSTRACT

A mount for photographic lighting equipment. The mount includes a mounting bracket and a support ring having a first axis that extends perpendicular to any given diameter of the ring. The support ring is carried by the mounting bracket, and the lighting equipment is connected to the support ring in such a way that not only is the lighting equipment rotatable relative to the mounting bracket about a second axis that extends essentially perpendicular to the first axis, but is also rotatable about the first axis.

8 Claims, 4 Drawing Sheets

MOUNT FOR PHOTOGRAPHIC LIGHTING EQUIPMENT

BACKGROUND OF THE INVENTION

The present invention relates to a mount for photographic lighting equipment, such as reflectors, lights (especially flash devices), etc. that has a cornered light-discharge opening, with the mount including a mounting bracket on which the lighting equipment is mounted in such a way as to be rotatable about an axis.

With the heretofore known mounts of this type, the photographic equipment, such as a reflector, light, etc., is rotatably mounted directly in the mounting bracket. With reflectors or lights, the discharge openings frequently have a rectangular cross-sectional shape. Due to this rectangular shape, the reflectors or lights cannot be selectively oriented in the direction of the long or short sides. In practice, this is frequently a great drawback, because if the reflector or light needs to be disposed in an upright manner, a second device is generally required to accomplish this.

It is an object of the present invention to embody a mount of the aforementioned general type in such a way that the photographic lighting equipment can be oriented and adjusted not only in the direction of the long side but also in the direction of the short side.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The mount of the present invention comprises a mounting bracket, and a support ring having a first axis that extends perpendicular to any given diameter of the ring, with the latter being carried by the mounting bracket; the lighting equipment is connected to the ring in such a way that not only is the lighting equipment rotatable relative to the mounting bracket about a second axis that extends essentially perpendicular to the first axis, but is also rotatable about the first axis.

With the inventive mount, the photographic lighting equipment can be adjusted via the support ring about a second axis. If the lighting equipment has a rectangular discharge opening, the equipment can be adjusted relative to the mounting bracket in such a way that the long side of the discharge opening is disposed either horizontally or vertically. All intermediate positions are also possible. Thus, the lighting equipment can be rotated about two axes, so that with one and the same mount it is possible to set a given lighting equipment in very different positions.

Further features of the present invention will be described in detail subsequently.

DESCRIPTION OF PREFERRED EMBODIMENTS

Figure 1:
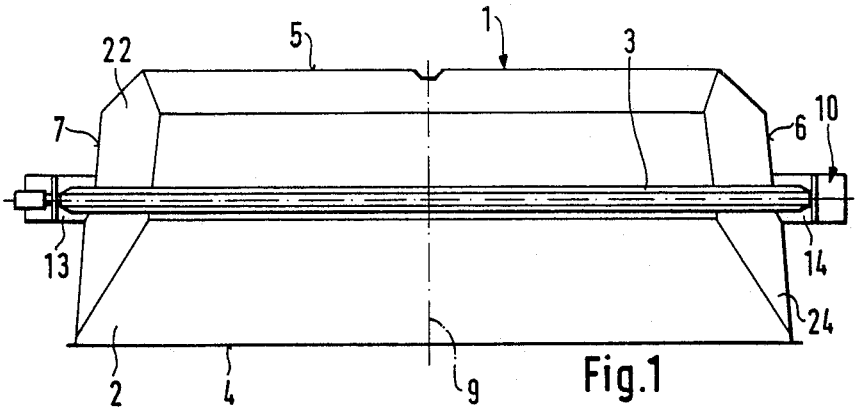
FIG. 1 is a top view of one exemplary embodiment of the inventive mount.
Figure 3:
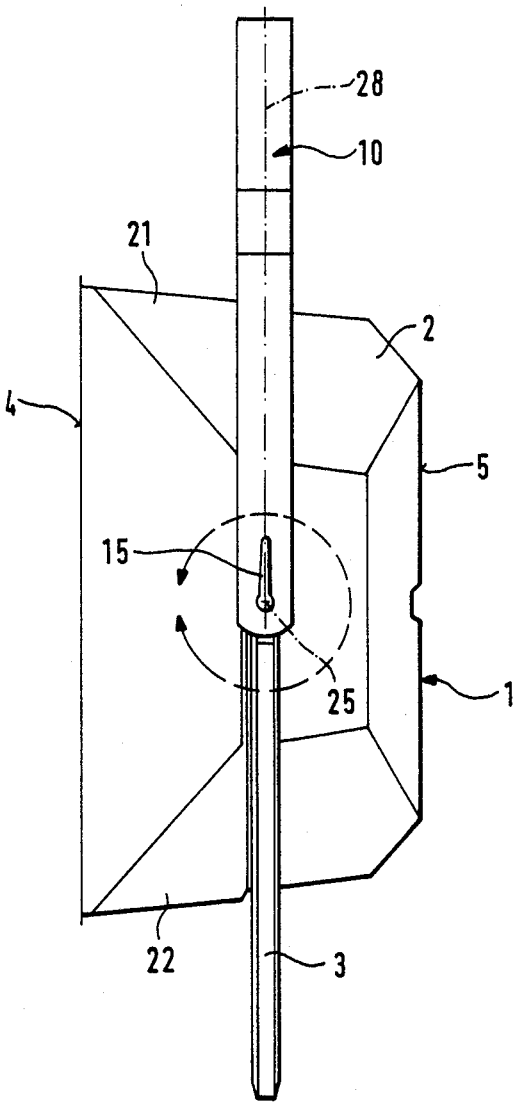
FIG. 3 is a side view of the mount of FIG. 1.

Referring now to the drawings in detail, with the inventive mount, lighting equipment, such as reflectors, lights, especially flash devices, and the like can be attached and can be adjusted in any desired direction. In the illustrated embodiment, the mount is used for a light 1 that has a quadrilateral contour. The housing 2 of the light 1 extends through a support or profiled ring 3. As shown in FIGS. 1 and 3, the ring 3 is disposed approximately half way up the housing 2. The diameter D of the ring 3, as mentioned subsequently in this description under predetermined circumstances, is equal at most to the longer diagonal A of the quadrilateral or rectangular housing 2 in the region of the end thereof, plus the appropriate tolerance of this rectangular shape. In the illustrated embodiment of FIG. 3, however, the diagonal A at the front end 4 is greater than the diameter D of the ring 3, because the housing 2 becomes wider from the back end 5 in the direction toward the front end 4. The sidewalls 6, 7 of the housing 2 thus extend at an angle in the direction toward the front end 4. Disposed in the back end 5 of the housing 2 is a means 8 for receiving a lamp, flashbulb, etc. The light emitted thereby exits the housing 2 at the front end 4.

If the housing 2 under predetermined circumstances has a constant cross-sectional area from the back end to the front end, then the diameter D of the ring 3 corresponds to the longer diagonal A of the housing, plus the appropriate tolerance. The housing 2 could also, for example, have a square contour, at least in the region of the ring 3. Every other suitable cross-sectional shape of the housing 2 is also possible.

The housing 2 is rotatable about the axis 9, which preferably extends through the center of the receiving means 8. In this way, the housing 2, with an illumination surface that has a rectangular or square cross-sectional shape, can be rotated about the axis 9 into any desired position. For this purpose, the housing 2 can be non-rotatably connected to the ring 3, which in turn is mounted to a mounting bracket 10 in such a way that the ring 3 is rotatable about its axis 9. Provided on each free end of the legs 11, 12 of the mounting bracket 10 is a respective bearing 13, 14 for the ring 3. The bearings 13, 14 embrace the ring 3, so that the latter is reliably guided in the bearings. After having been rotated into a given position, the ring 3, along with the housing 2 that is non-rotatably connected thereto, can be secured in this position via a non-illustrated clamping device.

Figure 2:
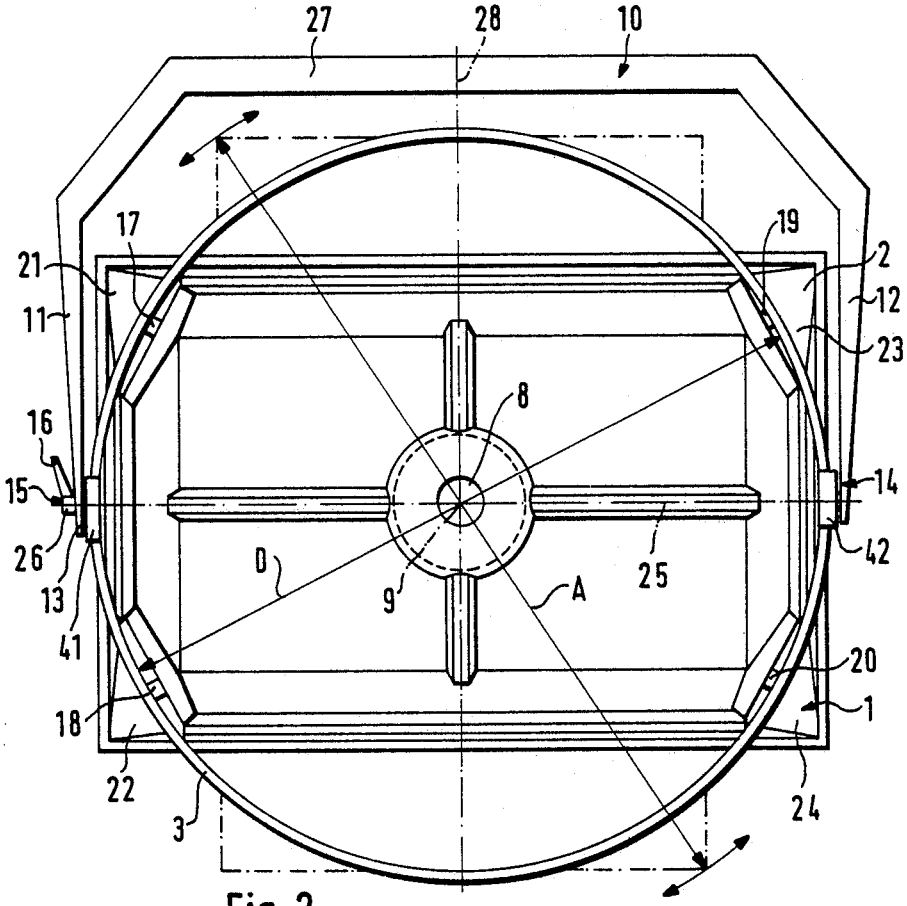
FIG. 2 is a front view of the mount of FIG. 1.

FIG. 2 shows the two extreme positions of the light 1. The solid lines show that position of the light 1 where the longer sides of the housing are disposed horizontally. From this position, the housing 2, along with the ring 3, can be pivoted in two directions about the axis 9 until the housing assumes the upright position illustrated by dashed lines in FIG. 2. Between these two extreme positions, any other suitable position of the light 1 is possible. Since rotation is possible by 360°, the light 1 can selectively be oriented in the direction of its long or narrow sides, depending upon the desired lighting conditions and/or the local conditions.

Pursuant to one preferred embodiment illustrated in the drawings, the light 1 is rotatably disposed in the ring 3. In this case, the ring 3 itself is not rotatable about the axis 9. The housing 2 of the light 1 is provided with a plurality of guide elements 17 to 20 that extend into the ring 3. The corners Of the housing 2 are bevelled, so that the housing is provided with appropriate planar inclined surfaces 21 to 24. The guide elements 17 to 20 are disposed on these inclined surfaces. Since the housing 2 extends into the ring 3 via the guide elements 17 to 20. the housing is positively connected to the ring 3 in the direction of the axis of rotation 9. The guide elements 17 to 20 can, for example, be rollers, while the ring 3 can have a U-shaped cross-sectional area. In this case, the rollers would be disposed between the legs of the ring 3. Once a given position of the housing 2 relative to the ring 3 has been set, the housing can be arrested or clamped in any suitable manner.

Figure 5:
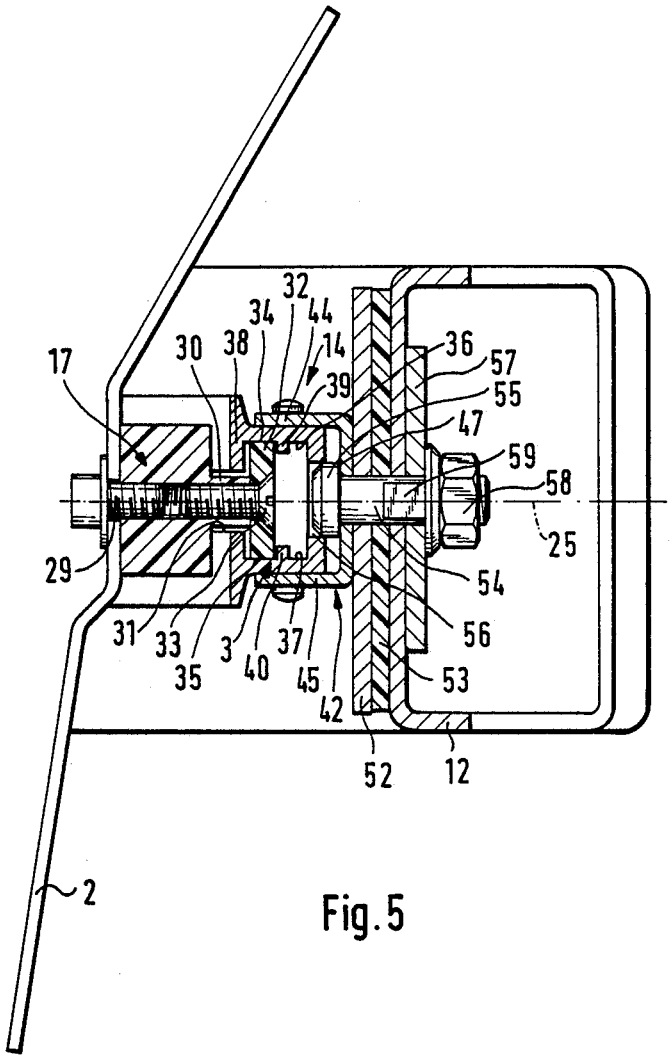
FIG. 5 is a cross-sectional view of the support of the profiled support ring of the inventive mount on the other leg of the mounting bracket.

FIG. 5 illustrates one of the guide elements 17 to 20. In this embodiment the guide element 17 is formed by a plastic part that preferably has a circular, cross-sectional shape. The guide element 17 is secured to the housing 2 via a screw 29. The guide element 17 has a cylindrical extension 30 of reduced diameter. The extension 30 projects, with play or clearance, through a slot 31 disposed about the periphery of the ring 3. Disposed within the ring 3 is a plate-like guide piece 32 that is connected to the guide element 17 via a countersunk screw 33. Via the screw 33, the guide piece 32 is tightly pressed against the cylindrical extension 30 of the guide element 17. The guide piece 32 is curved over its entire length in conformity to the shape of the ring 3, with the two ends 34 and 35 of the guide piece 32 resting against the facing inner sides 36 and 37 of the ring 3. The guide element 17 and the guide piece 32 are made of a plastic material that has a good sliding property, such as polytetrafluorethylene or nylon.

The slot 31 is provided halfway up one longitudinal side 38 of the ring 3. Halfway along the facing inner sides 36, 37 of the sidewalls of the ring 3, which are disposed parallel to the axes of the screws 29, 31, each of the sidewalls is provided with a projecting rib 39 or 40, as a result of which the guide piece 32 of the guide element 17 can be guided transverse to the longitudinal axis of the ring 3. All of the guide elements 17 to 20 are embodied in the manner just described and are guided in the ring 3.

Figure 4:
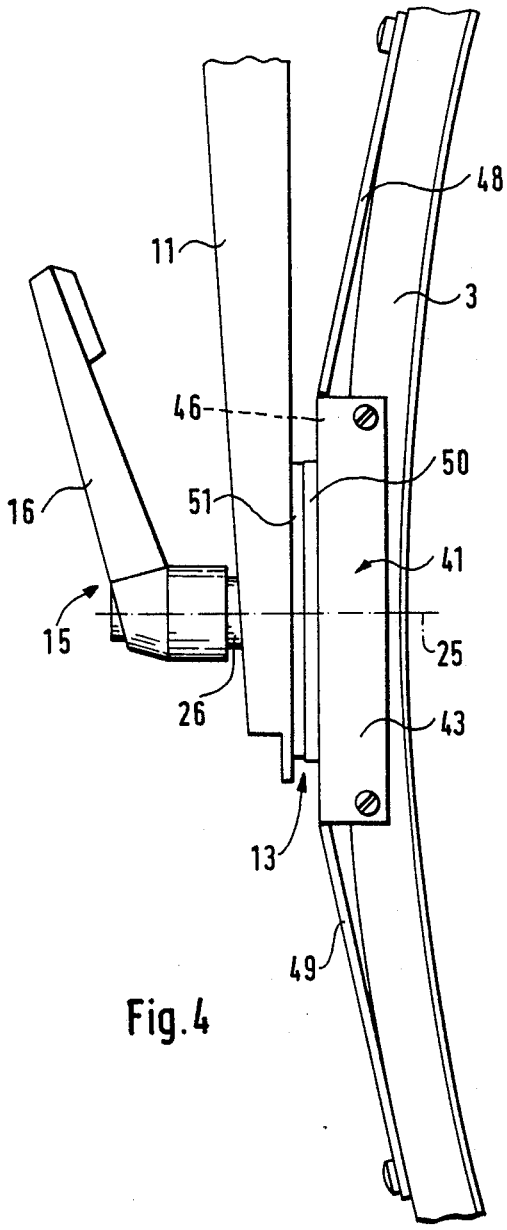
FIG. 4 is an enlarged view of a portion of a profiled support ring of the inventive mount, with the ring being rotatably mounted on the free end of a leg of a mounting bracket.

In the vicinity of the bearing or support 13, 14 (FIG. 2), the ring 3 is connected to the leg 11, 12 of the mounting bracket 10 via holding elements 41, 42. As shown in FIGS. 4 and 5, the holding elements 41, 42 are essentially U-shaped, with the legs 43 to 45 thereof extending over the ring 3. The crosspiece 46, 47 of the holding element 41, 42 extends beyond the leg 43, 45 at both ends. From the crosspiece 46, 47, the extensions 48, 49 extend at an angle, with their free ends being screwed to the ring 3 (FIG. 4). In addition, the legs 43 to 45 of the holding elements 41, 42 are secured to the ring 3. In this way, the ring is reliably and securely held.

The linearly extending crosspieces 46, 47 of the holding elements 41, 42 rest flush against one of two friction disks 50, 51 and 52, 53. These friction disks rest against one another and are screwed to the respective leg 11 or 12 of the mounting bracket 10. For this purpose, as shown in FIG. 5 the support 14 has a holding pin 54 that extends through the friction disks 52, 53 and the crosspiece 47 of the holding element 42; a widened end 55 of the holding pin 54 rests against the crosspiece 47. Since the ring 3 is spaced only slightly from the crosspiece 47, the ring 3 is provided with an appropriate recess or opening 56 in the region of the end 55 of the holding pin 54. Along with the interposition of a washer or the like 57, a nut 58 is screwed onto the holding pin 54. By means of this nut 58, the crosspiece 47 of the holding element 42, the friction disks 52, 53, the leg 12 of the mounting bracket 10, and the washer 57 are pulled tightly against one another. The leg 12 is embodied as a hollow profiled member, with the nut 58 and the washer 57 being concealed thereby. In the region of the nut 58, the leg 12 of the mounting bracket 10 is provided with an appropriate opening so that the nut 58 can be easily manipulated. That end of the holding pin 54 that is directed toward the nut 58 is provided with flattened portions 59 that prevent the pin from turning and also prevent an unintentional loosening of the nut 58.

As shown in FIG. 4, at the opposite support 13 the friction disks 50, 51 of the crosspiece 46 of the holding element 42, and the leg 11 of the mounting bracket 10, are in principle interconnected in the same manner. However, in place of the nut 58, a clamping lever 16 with a pressure piece 26 is screwed onto the non-illustrated holding pin. The lever 16 together with the pressure piece 26 form a part of a clamping mechanism 15,.

The unit including the ring 3 and the light 1 can, in turn, additionally be rotated relative to the mounting bracket 10 about a axis 25 that is disposed perpendicular to the axis 9 (FIGS. 2 to 5). This axis of rotation of 25 is formed by the axes of the holding pins 54 of the two supports 13, 14 at the free ends of the legs 11, 12 of the mounting bracket 10. The supports 13, 14 are embodied as pivot supports that are connected to the ring 3. Regardless of whether the ring 3 itself is rotatably connected in the supports 13, 14 or is fixedly connected thereto, the ring 3 together with the light 1 can be rotated about the axis 25 by 360° in both directions (FIG. 3). The axis of rotation 25 is disposed on the diameter of ring 3 (FIG. 2). By means of the clamping mechanism 15, the ring 3 can be secured in position relative to the mounting bracket 10. If the ring 3 with the housing 2 is to be rotated about the axis 25, the lever 16 is backed off, thus reducing the friction between the friction disks 50, 51. The nut 58 at the opposite support 14 has been set in such a way that when the clamping mechanism 15 is loosened, the ring 3 with the housing 2 can be rotated about the axis 25. As soon as the desired position of the ring 3 and the housing 2 is attained, a clamping effect at the support 13 is reestablished via the lever 16 and the pressure piece 26. Since the nut 58 is not loosened when the ring 3 is rotated about the axis 25, after an adjustment the ring 3 and the housing 2 remain in any given position, thus making it possible to easily adjust the light 1.

In place of the friction disks, it would also be possible to use toothed disks or the like in order to prevent the ring 3 from rotating about the axis 25 relative to the mounting bracket 10.

Another possibility for adjusting the light 1 would be to rotatably mount the mounting bracket 10 as well. For this purpose, the crosspiece 27 of the mounting bracket 10 that connects the two legs 11, 12 can, for example halfway along its length, be rotatably mounted about a further axis 28 that is disposed perpendicular to both the axis 9 and the axis 25 (FIGS. 2 and 3). The crosspiece 27 is provided with an appropriate, not-illustrated pivot support, so that the mounting bracket 10, together with the ring 3 and the light 1, can be rotated about the axis 28. All three axes 9, 25, and 28 preferably intersect in the center of the ring 3.

With the inventive mount just described, the light 1 can be placed in any desired position. It is thus possible to optimally adjust the light.

The present invention is, of course, in no way restricted to the specific disclosure of the specification and drawings, but also encompasses any modifications within the scope of the appended claims.

What I claim is:

1. A mount for photographic lighting equipment, comprising:

a mounting bracket;

a support ring having a first axis that extends perpendicular to any given diameter of said ring, with the latter being carried by said mounting bracket, and with said lighting equipment being mounted on said support ring in such a way that not only is said lighting equipment rotatable relative to said mounting bracket about a second axis that extends essentially perpendicular to said first axis of said ring, but said lighting equipment is also rotatable about said first axis, said mounting bracket includes means for the mounting bracket to be rotatably mounted about a further axis that is disposed perpendicular to both said first axis and said second axis; said lighting equipment being mounted on said support ring in such a way as to be rotatable relative to the latter about said first axis thereof; and said lighting equipment being provided with guide elements, and in which said support ring is embodied as a profiled ring into which said guide elements extend.

2. A mount for photographic lighting equipment, comprising:

a mounting bracket; and a support ring having a first axis that extends perpendicular to any given diameter of said ring, with the latter being carried by said mounting bracket, and with said lighting equipment being mounted on said support ring in such a way that not only is said lighting equipment rotatable relative to said mounting bracket about a second axis that extends essentially perpendicular to said first axis of said ring, but said lighting equipment is also rotatable about said first axis;

said lighting equipment being mounted on said support ring in such a way as to be rotatable relative to the latter about said first axis thereof;

said lighting equipment being provided with guide elements, and said support ring is embodied as a profiled ring into which said guide elements extend; and said support ring being rotatably mounted on said mounting bracket in such a way as to be rotatable about said second axis.

3. A mount according to claim 2, in which said mountinq bracket has two legs, each of which has a free end through which said second axis of rotation extends and on which said support ring is mounted.

4. A mount according to claim 3, in which a clamping mechanism for said support ring is provided on said free end of one of said legs of said mounting bracket.

5. A mount according to claim 3, in which said mounting bracket is rotatable about a third axis that extends at right angles to both said first and second axes.

6. A mount according to claim 5, in which said first, second, and third axes intersect one another in the center of said support ring.

7. A mount according to claim 5, in which said mounting bracket has a U-shaped configuration, with said two legs being interconnected by a crosspiece that is provided with a pivot support through which said third axis extends.

8. A mount for photographic lighting equipment including a light, comprising:

a mounting bracket having at least two legs; and a support ring having a first axis that extends perpendicular to any given diameter of said ring, with the latter being carried by said mounting bracket, and with said lighting equipment being mounted on said support ring in such a way that not only is said lighting equipment rotatable relative to said mounting bracket about a second axis that extends essentially perpendicular to said first axis of said ring, but said lighting equipment is also rotatable about said first axis, said lighting equipment being mounted on said support ring in such a way as to be rotatable relative to the latter about said first axis thereof, said lighting equipment being provided with guide elements, and said support ring is embodied as a profiled ring into which said guide elements extend, and a crosspiece of said mounting bracket that connects two legs of said mounting bracket as means for the mounting bracket to be rotatably mounted about a further third axis that is disposed perpendicular to both said first axis and said second axis so that the mounting bracket, together with said support ring and the light, can be rotated about said further third axis, all three of said first, second and third axes intersecting in a center of said support ring.

* * * * *

UNITED STATES PATENT AND TRADEMARK OFFICE

CERTIFICATE OF CORRECTION

PATENT NO. : 4,811,923

DATED : March 14, 1989

INVENTOR(S) : Walter Haberthür

It is certified that error appears in the above-identified patent and that said Letters Patent is hereby corrected as shown below:

On the title page, please correct the Foreign Application Priority Data to read as follows:

[30] Foreign Priority Data

Feb. 25 1987 [DE] Fed. Rep. of Germany...8702841[U]

Signed and Sealed this

Twenty-ninth Day of August, 1989

*Attest:*

DONALD J. QUIGG

*Attesting Officer*

*Commissioner of Patents and Trademarks*